United States Patent [19]

Spikes

[11] Patent Number: 4,651,823

[45] Date of Patent: Mar. 24, 1987

[54] CENTRALIZER

[75] Inventor: Hugh D. Spikes, Weatherford, Tex.

[73] Assignee: Antelope Oil Tool & Mfg. Company, Tex.

[21] Appl. No.: 864,461

[22] Filed: May 19, 1986

[51] Int. Cl.[4] ..... E21B 17/10

[52] U.S. Cl. ..... 166/241; 175/325

[58] Field of Search ..... 166/241; 175/325

[56] References Cited

U.S. PATENT DOCUMENTS

| | | | |
|---|---|---|---|
| 2,727,576 | 12/1955 | Hall | 166/241 |
| 2,998,848 | 9/1961 | Wright et al. | 166/241 |
| 3,044,554 | 7/1962 | Kluck | 166/241 |
| 3,356,147 | 12/1967 | Dreyfuss | 166/241 |
| 4,011,907 | 3/1977 | Clay | 166/241 |
| 4,143,713 | 3/1979 | Kreft | 166/241 |
| 4,206,808 | 6/1980 | Kreft | 166/241 |
| 4,219,081 | 8/1980 | Howe | 166/241 |
| 4,269,269 | 5/1981 | Wilson | 166/241 |
| 4,363,360 | 12/1982 | Richey | 166/241 |
| 4,520,869 | 6/1985 | Svenson | 166/241 |
| 4,545,436 | 10/1985 | Harrison | 166/241 |

*Primary Examiner*—Stephen J. Novosad
*Assistant Examiner*—Thomas J. Odar
*Attorney, Agent, or Firm*—Thomas M. Scofield

[57] ABSTRACT

A new well bore centralizer construction; a well bore centralizer construction which may be shipped in disassembled condition by the manufacturer, occupying the smallest volume of space, to be later assembled; a field-assembleable casing centralizer consisting of a pair of vertically spaced apart collars and connecting, outwardly bowed leaf springs secured to the collars by a liner construction therewithin, wherein movement of the leaf spring ends in one direction is prevented by engagement therewith of liner tabs which engage openings in the leaf spring ends, movement of the leaf springs being prevented in the other direction by shaping of the collar and the positioning of the liner with respect thereto; improvements in the structure and methods of connection of the ends of leaf springs to centralizer collars in field assembleable centralizers.

6 Claims, 8 Drawing Figures

Fig.4.
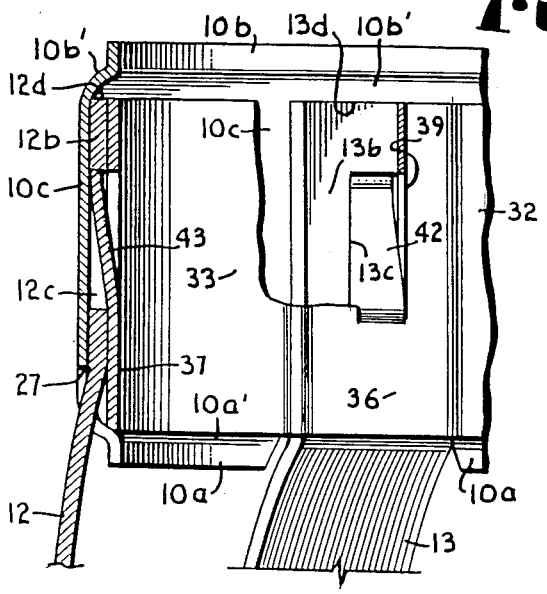
Fig.5.
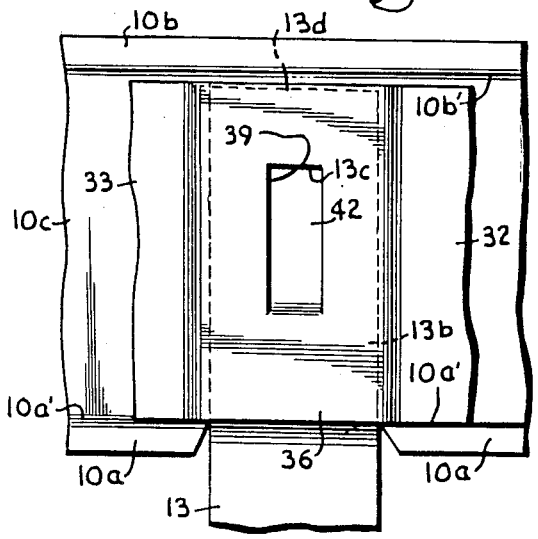
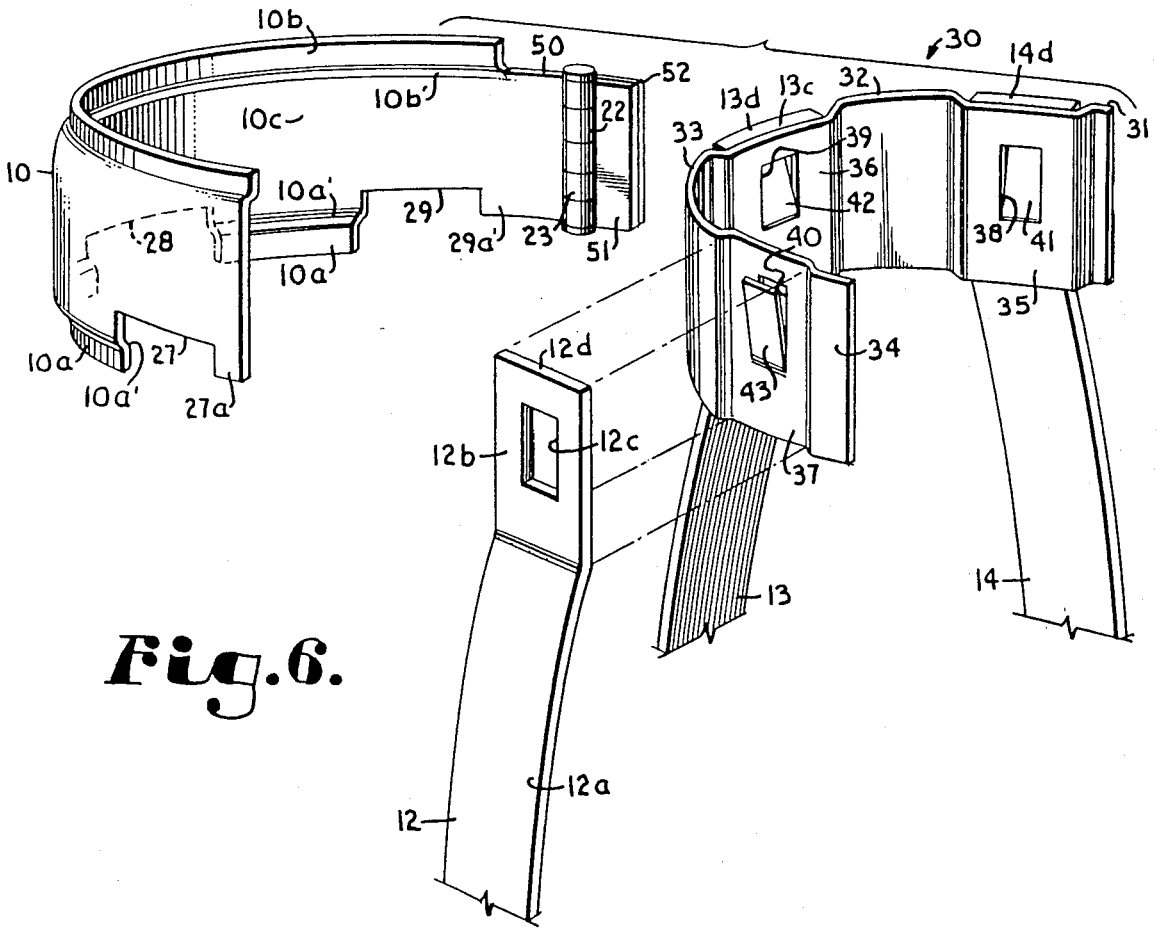
Fig.6.

CENTRALIZER

BACKGROUND OF THE INVENTION

The subject improvement relates to centralizers or centralizing devices operative to locate a casing or pipe string concentrically within a well bore or another casing. It is particularly directed to a non-weld centralizer which can be packaged in originally disassembled form for space-efficient shipping and easily and conveniently finally assembled in the shop or place of business of the purchaser or actually on the job site.

Typically, centralizing devices generally comprise upper and lower collar members adapted to removably encircle and embrace a casing or pipe, the collar members having a plurality of outwardly bowed spring members attached at the upper and lower ends thereof in various manners or ways to the collars. Such collars conventionally and conveniently are constructed of two or more arcuate sections with means of various types provided for joining the arcuate sections together after such are placed around a pipe or casing. Hinge and latch are typical. The spring members may be welded to the collar sections or mechanically attached thereto by various means and devices.

In actual use, centralizers are ordinarily supported on a pipe or casing at vertically spaced locations along its length. The outwardly bowed spring members yieldably engage the well bore or the inside surface of other casings circumferential thereto at spaced locations therealong. The well pipe may be a casing disposed within an open well bore or within another casing in the wellbore which, when centered, permits a uniform column of cement to be pumped into the annular space between it and what surrounds it.

When mounted on a pipe or casing section, centralizers are typically supported for limited endwise movement by one or more stop collars, the latter fixedly clamped or attached about the pipe or casing. A pair of such collars may be attached to the casing above and below the centralizer collars or a single stop collar may be clamped or otherwise attached to the casing intermediate the centralizer collar sleeve ends or both. In either case, the stop collars or stop members are so located with respect to the centralizer collars that the latter are freed to move towards and away from one another as the bowed springs expand and contract. This permits the centralizers to function in well bores of somewhat different diameters.

A major factor in the design of many centralizers is the manner in which the bowed spring members are connected or connectible to the end collars of the centralizer. Such connection governs the manner in which the centralizers may be originally assembled, whether only by the manufacturer at the place of manufacture or at a purchaser's shop, a field installation, on the job site, etc. The key difference is whether the centralizing device parts are originally fully assembled at the place of manufacture or manufactured and prepared in a state of disassembly for shipping to a spot for assembly away from the point of manufacture.

Clearly, a fully assembled centralizer occupies a relatively great volume of space compared to the volume required for its component parts nested or packed in sets for shipping. Thus, in order to minimize the shipping costs of centralizers to distant locations, non-weld centralizer or centralizers that are easily entirely or partially assemblable by the purchaser in his facilities or in the field have been developed. Many prior such designs have been provided, some of which are noted in the Prior Art section given herebelow.

A basic factor with respect to any centralizer construction, however, is that it must be not only structurally sound when assembled, it must also be sufficiently strong, once assembled, that it will effectively function in the well bore environment and not be easily damaged by the rough treatment normally encountered in well bore use.

Another important factor which is frequently not sufficiently considered in other centralizer designs or not present or allowed for in other centralizer designs is that the crew on the job site or at the assembly point may be laboring under such job site and assembly point conditions as will preclude sophisticated handling of complexly shaped pieces. Still further, job site or assembly point personnel may be generally relatively unsophisticated with respect to complex apparatus assembly. It follows, that, in order to be effective and useful in its job, a centralizer which is assembleable away from the point of manufacture or on the job site should be of extremely simple construction and assembleable in a manner that does not heavily tax either the facilities or skills of the job site personnel.

THE PRIOR ART

Applicant is aware of the following patents particularly directed to non-weld centralizers.

Atkinson U.S. Pat. No. 2,680,488 "Device For Centralizing Casings In Bore Holes", issued June 8, 1964;

Park U.S. Pat. No. 3,055,432 "Well Conduit Centering Devices" issued Sept. 25, 1962;

British No. 1,156,710 Caslake published July 2, 1969, "Improvements In Or Relating To Devices For Centralizing Pipes In Borings";

British No. 1,532,853 Wills et al "Improvements In Or Relating To Devices For Centralizing Pipes In Borings", published Nov. 22, 1978;

Wills et al U.S. Pat. No. 4,042,022, issued Aug. 16, 1977 "Devices For Centralizing Pipes In Borings";

Dane U.S. Pat. No. 4,077,470 issued Mar. 7, 1978 for "Well Centralizer And Method Of Making"; and Harrison, U.S. Pat. No. 4,545,436, issued Oct. 8, 1985 for "Centralizer Band- Collar Connection".

BRIEF SUMMARY OF THE INVENTION

The subject device is a centralizer for mounting on a well casing operable to function in the annular space between the casing and well bore or the casing and a concentric second casing. The subject centralizer has a pair of axially spaced apart collars slideably fittable to the exterior of the casing or pipe on which it is to be mounted. A plurality of outwardly bowed spring members span the space between the collars and are substantially equally spaced circumferentially of the collars. One of the ends of each bow or spring member is attached to the upper collar, the opposite end thereof to the lower collar.

Each of the centralizer collars has upper and lower edges of lesser internal diameter, thereby to closely fit on and engage the casing with the upper and lower edges thereof. The intermediate portion of each said collar is of greater internal diameter than the upper and lower edges thereof, thus to be spaced outwardly from the casing when the collars are mounted on and engage same. The inboard, adjacent, relatively lesser internal diameter edges of the collars are relieved in a plurality of spaced portions thereof, thus to receive portions of the ends of the spring members thereunder and therepast.

Each collar is adapted to receive, between the upper and lower edges of lesser internal diameter, insert or liner members extending between said upper and lower edges of lesser internal diameter. These inserts or liner members have spaced apart axial recesses formed therein with cut away central upper slots, the lower portions of which are taken up by inwardly formed tabs. The spaced apart recesses are placed in alignment with the relieved portions of the inboard, adjacent, relatively lesser internal diameter edges of the collars. Thus the recesses and relieved collar portions are together adapted to receive the ends of the bows or spring members.

As mentioned above, the bows themselves are arcuate in the elongate central portion thereof but, alternatively, are substantially straight in the end portions thereof. Within the end portions, such to be received in the liner's recesses, there are provided slots or holes designed to receive the liner tabs.

Thus, a spring member or bow end may be forced or hammered into the annulus between the collar wall and the liner or insert until the liner tab snaps, like a leaf spring, into the opening in the straight end portion of the bow or spring member. The general process of assembly may now be described.

In the process of manufacture, the liner or insert members are spot welded or otherwise fixedly attached into the collars with the recesses in the liners opposite the notches in the inboard collar walls. Then the collars, with the liners therewithin and the bows separate, may be shipped to any place, unassembled, greatly saving shipping space compared to a centralizer. Once the device is to be assembled, first, with respect to the bottom collar, each bow is hammered into the space between the liner and the collar until the liner tabs snap into the openings in the ends of the bows. At such point, the very ends of the bows will also be essentially against the inwardly formed bottom portion of the bottom collar which prevents the bow, in use, from being pushed axially (or longitudinally) out of the collar. The tab, which acts like a leaf spring, prevents the bow from escaping from the recess between the liner and the collar in the other direction.

Once all of the bottom collar bows have been hammered in, then the top collar is applied. This collar must simultaneously accept all of the upper ends of the bows into the slots or recesses between the inserts or liners and the upper collar. The top or upper collar is then hammered on or pressed on so that all of the bow ends at the tops of the bows lock into the liner/collar recesses in the same manner as with respect to the lower collar.

OBJECTS OF THE INVENTION

A first object of the invention is to provide improvements in basic centralizer design and construction.

Another object of the invention is to provide substantial improvements in non-weld or job site assembleable centralizer constructions where negative conditions at the assembly point or job site, minimal tooling and minimal training of job site personnel become of minimal importance.

Another object of the invention is to provide a centralizer construction of which the ends of the bowed spring members are connected to the centralizer end collars without the necessity of welding or complex fastener construction or, further, complex structural interelationships necessarily being provided between the ends of the spring members and the collars.

Still another object of the invention is to provide a purchaser or on job site assembleable centralizer construction wherein both the collar construction and the configuration and construction of the outwardly bowed spring members, as well as the engagement between the spring ends and the collars, are of the greatest simplicity, thus to minimize manufacture and cost as well as problems in assembly in the field.

Another object of the invention is to provide such a non-weld centralizer construction wherein all of the end connection means for the spring bows are positioned interiorly of the centralizer collars whereby to be fully protected therewithin and thus be more durable.

Yet another object of the invention is to provide such a non-weld centralizer construction wherein the stabilization of the ends of the bows with respect to the centralizer collars is by two separate means with respect to the two possible directions of motion of the centralizer bows, whereby to greatly strengthen the attachment of the bows to the centralizer and extend the life of the centralizer.

Other and further objects of the invention will appear in the course of the following description thereof.

DRAWINGS

In the drawings, which form a part of the instant specification and are to be read in conjunction therewith, an embodiment of the invention is shown and, in the various views, like numerals are employed to indicate like parts.

FIG. 4 is a fragmentary view of a portion of the exploded apparatus of FIG. 6 assembled, involving the left hand two bows, liner portion and collar portion of the structure seen in FIG. 6. The left hand end of FIG. 4 is a section through the center of the first, nearest recess in the liner when the latter is assembled in the left hand end of the collar of FIG. 6. In the right center of the view of FIG. 4 a portion of the liner inside the upper collar is also cut away to better show the engagement of the leaf spring tab with one of the bow ends in the liner recess.

FIG. 5 is a head on view looking right at an arcuate segment of the assembled interior upper collar of FIG. 4 showing the end of one leaf spring received in one liner recess and the leaf spring tab engaged in the bow end opening. This view is from the inside of the collar looking radially outwardly and involves the center portion of the apparatus of FIG. 6 and right hand side of FIG. 4.

FIG. 6 is an exploded view showing, on the left, one half segment of an upper collar before the liner is received therewithin. The righthand section of the view shows a liner segment adapted to be positioned in and welded to the collar portion before receiving the ends of the bows. However, in order that the relationship of the ends of the bows to the liner construction and the spring tabs may be seen outside of the enclosure of the assembled collar/liner, a plurality of bow ends are shown engageable with and engaging the recesses of the liner prior to the liner being inserted in the collar.

Figure 2:
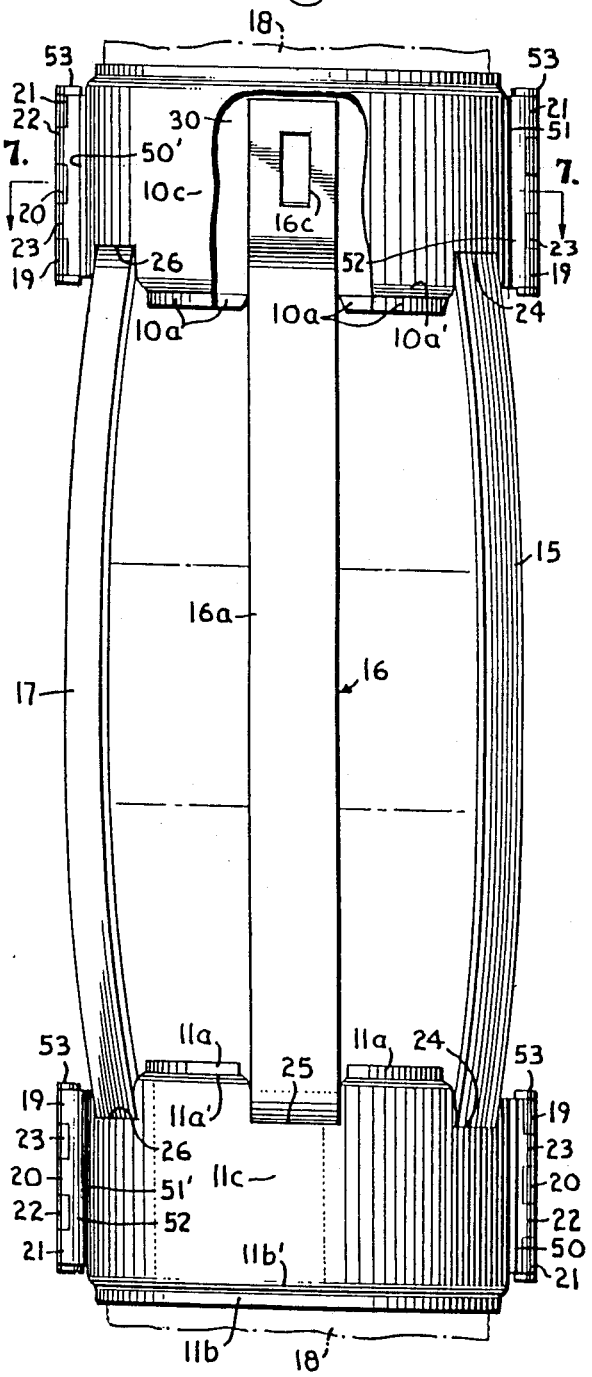
FIG. 2 is a side elevation of the subject centralizer also shown mounted on a casing with the hinge and latch sections on the centralizer collars positioned to the left and right sides of the view, respectively. A portion of the upper collar is cut away to better show the position of the upper end of one bow or spring with respect to the near upper centralizer collar position.
Figure 7:
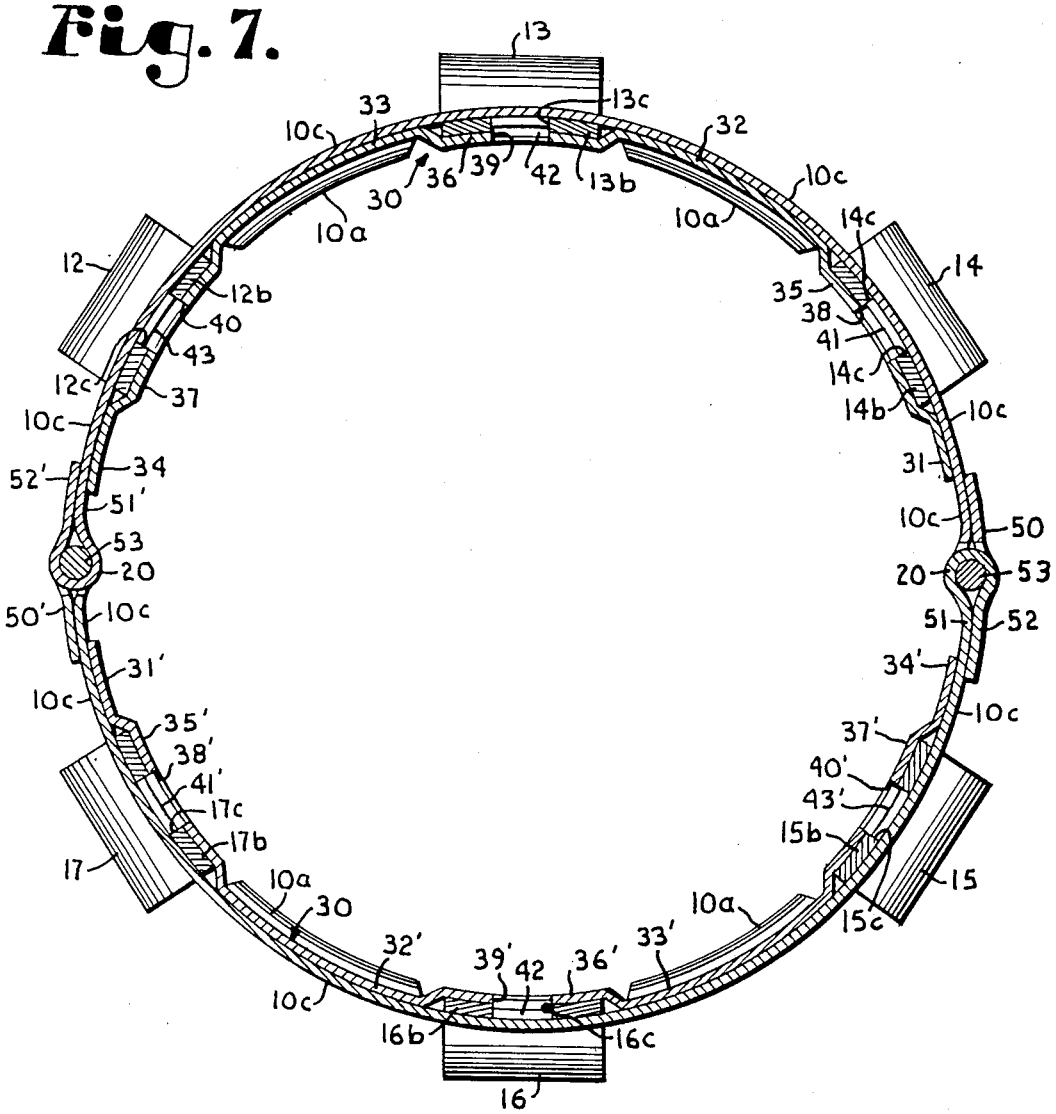

FIG. 7 is a view taken along the line 7—7 of FIG. 2 in the direction of the arrows.

Figure 8:
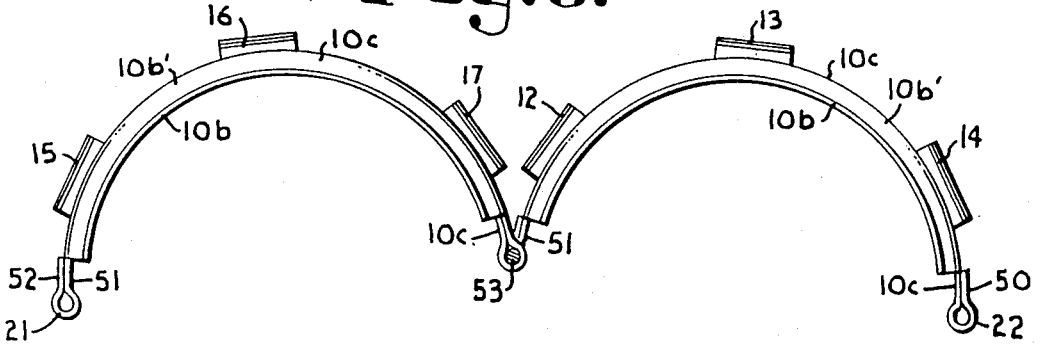

FIG. 8 is a top plan view of the centralizer of the previous figures opened 180° from the closed position of FIGS. 1-3 and 7.

STRUCTURE AND FUNCTION

Figure 1:
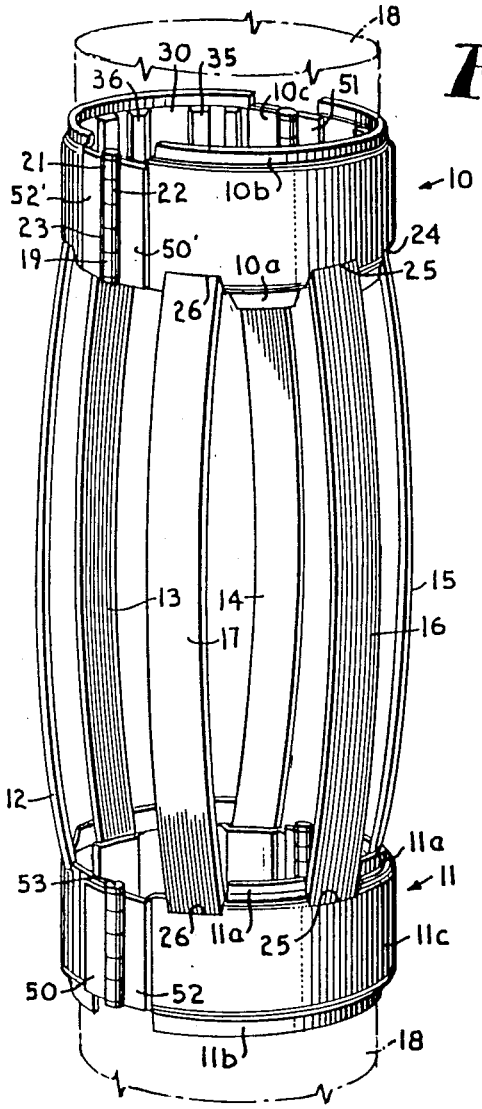
FIG. 1 is a three-quarter perspective view, slightly from above, of the subject improved centralizer construction showing same mounted on a casing, a hinge or latch section appearing in the left hand side of the view on the collars, such opposed by an opposite hinge or latch section.

Referring to the drawings, therein is seen the particular centralizer improvement. First, broadly characterizing the structure, there are two axially spaced apart collars, such generally designated 10 and 11. These are interconnected by, in the specific embodiment shown, six outwardly bowed spring members 12–17, inclusive. The ends of the spring or bow members 12–17, inclusive are rigidly connected to collars 10 and 11, in a manner to be described in detail, thus spacing the said collars 10 and 11 vertically and axially apart as seen in FIGS. 1 and 2. The detailed structure of the collars will first be described, then the detailed structure of the spring or bow members and, finally, their interconnection and integration in the assembled product.

In the subject device, referring first to collars 10 and 11, each collar is made up of two identical segments. Further, the two collars are made up of four identical segments. In this manner, segments are interchangeable, one with the other. Accordingly, the full description of one segment will describe each other segment, although the segments in the respective collars at each end of the centralizer are inverted with respect to one another so that like edges will be facing like interiorly of the centralizer.

In the following description of the collar segments, two like sets of numerals will be placed on the segments at the centralizer opposite ends, it being understood that each collar segment is identical with the others and four identical such segments may be joined together to form the upper and lower collars. So proceeding, each said collar has inboard and outboard edges: **10*a* and 11*a* are inboard, while 10*b* and 11*b* are the outboard collar edges, portions or flanges. The inboard collar edges 10*a* and 11*a* are interrupted as may be seen and will be described in detail, while the outboard flanges or edges 10*b* and 11*b*** are essentially continuous on each collar segment.

Figure 3:
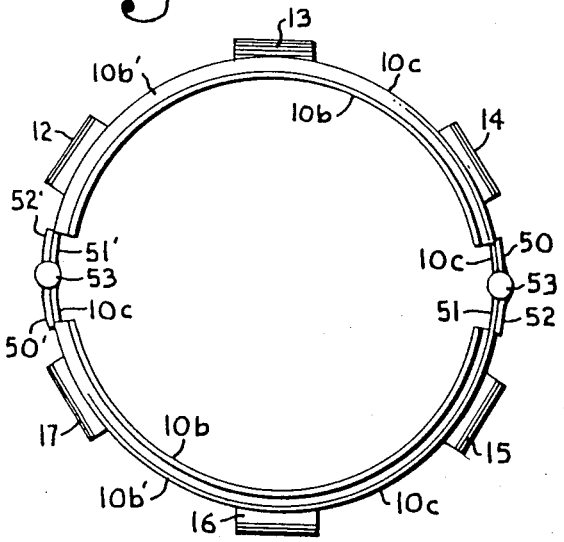
FIG. 3 is a plan view of the subject device taken from the top of FIG. 2 looking downwardly in that view.

These ends, flanges or edges are of an internal diameter such that, when the collar segments are closed, as in FIGS. 1-3, inclusive, collars 10 and 11 closely fit around the pipe or casing 18 (schematically shown in FIGS. 1 and 2) on which the centralizer is mounted, at these edges.

Immediately next to the flange or edge portions just described, there are outwardly angled flange portions **10*a*', 10*b*', 11*a*', and 11*b*' which operate to connect the bearing flanges or edges 10*a*, 10*b*, 11*a*, 11*b* with the preferably substantially cylindrical, greater inner diameter collar portions 10*c* and 11*c***.

Anticipating the question of relative dimension to come later with respect to the insertion of the free ends of the spring or bow members 12–17, inclusive, inside or within a portion of the end collars 10 and 11, it should be noted that the minimum excess internal diameter of the collar body portions **10*c* and 11*c* over that of the bearing flanges 10*a*, 10*b*, 11*a* and 11*b*** must be at least (1) the thickness of the end of the spring or bow members plus (2) the thickness of the inserted, fixed liner member to be described.

The particular centralizer shown in the drawings has six spring members or bows, three to each collar segment employed with the device. With lesser diameter collars two spring members could be employed per collar segment. On the other hand, with lesser width spring members, or greater diameter collars, or both, four (or even more) spring members could be employed per collar segment.

However, when the device is purchaser or job site assembled, it is desired to have the minimum number of spring members to attach to the collars and thus the minimum number of attachment operations required. It boils down to providing the minimum number of effective members (bows or springs) in the centralizer here disclosed with respect to a given casing size.

Now looking at the connection structure of the ends of the collar segments, one endmost section thereof is initially formed with two elongate rectangular slots therethrough near the end of a collar segment and the end pieces 51, 52 then formed back on one another to provide, on one end thereof, the three hinge segments 19, 20 and 21. On the other end of the specific segment in question, in plate 50, one center rectangular opening is formed and two edge rectangular pieces removed, so that the segment hinge elements 22 and 23 may be formed. This provides, at the opposite ends of each segment, engageable ends for hinge or closure connection engagement with the ends of a like segment. Such construction is analogous to that seen in Hall, Sr. U.S. Pat. No. 2,666,241 "Band End Connection", issued Jan. 19, 1954, although that construction shows more hinge elements than are present in this structure. Additionally, preferably, at least some of the hinge elements of this structure are formed integrally with the collar metal originally provided, although such is not necessary.

In the area or zone of the hinges, the outboard flanges **10*b* and 11*b* are relieved. With respect to the inboard flange or edge portions 10*a* and 11*a*, only two portions of each of these are provided on the inboard edge of each collar segment. Neither of these are adjacent to a hinge section. The outboard bearing flanges 10*b* and 11*b* run a solid, lengthy arc from hinge segment to hinge segment outboard of the slots and inboard collar portion reliefs to be described. On the other hand, the inboard collar bearing portions 10*a* and 11*a*, as mentioned, run only between the zones of the bow or spring member inserts, 24–25 or 27–29** respectively in the construction shown, and thus are of considerably less bearing area on the casing.

Now looking at the zones **10*a* and 11*a* and the bows 12–17 with respect to their engagement with collars 10 and 11, the following may be noted. In the six bow centralizer shown (three bows per centralizer segment), three entrance slots for the centralizer ends must be provided in the inboard portions (10*a*, 10*a*' and 11*a* and 11*a*') of the collar segments. This construction is best seen in FIGS. 1, 2 and the lefthand side of 6. In the collar segments 10 and 11 carrying ends of bows 15–17, inclusive, the entry zones therefor will be numbered 24, 25 and 26 for bows 15, 16 and 17, respectively. It may be seen that the cuts or material removed zones 24, 25 and 26 go through the inboard flanges 10***a*, 11*a*, also through the outwardly angled portion 10*a'*, 11*a'* and further into the cylindrical wall (or near cylindrical wall) 10*c*, 11*c* for a substantial distance.

The reliefs in the inboard edges of the segments 10, 11 carrying bows 12, 13 and 14 are numbered 27, 28 and 29, respectively (see FIG. 6).

The structure of each of the outwardly bowed spring or bow members, particularly as is employed in the specific engagement with the collar segments heretofore described and liner segments yet to be described will be particularly characterized with respect to FIGS. 4, 5 and 6.

Each entire spring or bow member is of substantial U-shape in side view, but a very shallow U. Looking at, for example, bow member 16 centrally of FIG. 2, the center portion 16*a* thereof, constitutes the larger portion of its length (at least that distance between the collars 10 and 11 it is received within and locked with respect to). The two ends, only one of which is seen in FIG. 2, are not bowed, but, rather, are straight in their end length and parallel and axially in line with one another when manufactured. The end seen in FIG. 2 is labeled 16*b*. Reference is here made to the center portion of FIG. 6 where the bowed versus straight relationship of the parts of the bow or spring 12 may be seen with respect to the upper end of one of these springs. The center, nearest viewer, spring end 12*a* and 12*b* of FIG. 6 is identical to the structure of the upper portion of bowed center portion 16*a* and straight end section 16*b* of spring 16 in FIG. 2.

Liners 30 are provided, before assembly of the bows into the collars, which are fixed to the large internal diameter portions 10*c* and 11*c* of collars 10 and 11.

FIG. 6

For purpose of description, and geometric orientation, it is assumed that the upper collar 10 of FIG. 6 is that collar 10 which is seen in the upper lefthand corner of FIG. 1 and receives bows or springs 12–14, inclusive. This arcuate collar segment is seen at the top of FIG. 3, very little in FIG. 2, at the top end of FIG. 7 and in FIG. 6. Note the inboard casing bearing flanges 10*a*, the outboard casing bearing flange 10*b*; the lower and upper outwardly angled portions 10*a'* and 10*b'*, as well as the inner and outer surface of the greater internal diameter portion 10*c*. A hinge section is shown at the right of the collar portion 10, not connected thereto. However, the respective parts of such may be formed integrally with the ends of the collar segments as previously indicated or welded thereon after formation of the collar segments or both.

Attention is now directed to the liner section which is going to be received within the substantial entire interior height of the greater internal diameter collar portion 10*c*, particularly including down to the zones 10*a'* and up to the zone 10*b'*. The end wall portions 27*a* and 29*a*, which are next to the hinge section and also the openings 27 and 29 (also note central opening 28), will additionally receive part of the insert liner 30.

Such liner, seen in three-quarter perspective view from above in the right hand side of FIG. 6, the upper portion thereof, is generally designated 30. The radially outboard portions 31, 32, 33 and 34 are precisely sized and shaped to fit flat against the inner face of larger internal diameter collar portion 10*c*. These noted portions are welded or otherwise fixedly attached to the innerface of larger ID portion 10*c* running from the edge of tab 29 to the edge of tab 27. Portions 31 and 34 specifically overlie and are fastened to tab portions 27*a* and 29*a* and the collar portions thereabove up to zone 10*b'*.

Between abutment portions (attachment portions) 31–34, inclusive, there are provided radially inwardly formed recesses or channels 35, 36 and 37. These recesses or channels, which are radially inwardly formed far enough or deep enough to receive the end, such as 16*b*, of a bow or spring in sliding friction fashion therein are of uniform internal diameter and width their entire height, preferably, and open ended at both ends. They overlie openings 27, 28 and 29 (by portions 37, 36 and 35, respectively) and close off, inwardly) the lower portion thereof down to the level of zones 10*a'*. This closing off is strictly inwardly as an external gap or slot is left for the insertion of the spring ends, to be described.

A plurality of vertical, axial slots 38–40, inclusive are provided in the inwardly formed faces of channels or recesses 35–37, inclusive. Formed from the metal of the lower portion of the slot or otherwise separately welded or otherwise fixedly attached into slots 38–40, inclusive are spring like finger or tabs 41–43, inclusive. These tabs, as may be seen with respect to tab 43 in FIG. 6, normally project outwardly at a slight angle, like a leaf spring or tab. Thus they somewhat tend to block the entrance of the ends of the springs or bows into the liner recesses or channels from below in the view of FIG. 6, when the liner has been fixed to the inboard large diameter face of collar 10.

Each end of each bow or spring (see top of FIG. 2 and center of FIG. 6) has a preferably rectangular, elongate, axial opening as at 12*c* in FIG. 6 and 16*c* in FIG. 2. Opening 12*c* and tab 43 (FIG. 6) are so sized with respect to one another that, when the upper, straight portion 12*b* of bow or spring 12 is forced from below into the opening between the lower, inner edge of wall 37 and the uppermost portion of opening 27 in collar portion 10*c* and then driven upwardly until the top edge 12*b* is immediately below angle portion 10*b* of collar 10, the following will have happened. First, the upper end 12*d* of bow 12 moves upwardly, forced against the sliding, friction fit of it between wall 37 and the interior face of collar portion 10*c*. Next, the top end of bow 12*d* contacts the lower end of leaf spring or tab 43, forcing it to move outwardly toward the walls of slot 40 from which it may have been cut. As soon as the top edge of the opening 12*c* passes the top edge of leaf spring 43, the latter, by its natural and strong spring action, snaps into the opening 12*c*. Liners 30 and leaf springs 41–43, inclusive are typically of considerably lesser thickness than members 12–17, inclusive. However, the thickness of the liner is a substantial part of the thickness of the bow or springs 12–17, inclusive and thus the inwardly angled, snapped in leaf spring 43 strongly holds the bow or spring 12 against being pulled downwardly (in the view of FIG. 6) or toward the center of the centralizer, in any case.

There is, on the other hand, no attempt made to control movement of bow 12 (or the end portion 12*b* thereof) axially outwardly from the center of the centralizer by leaf spring 43 because the end 12*b* of bow 12 normally rests immediately under inwardly angled portions 10*b*. If strong well forces tend to force bow or spring 12 upwardly in the view of FIG. 6 out of the collar/liner engagement, the end 12*d* immediately abuts against portion 10*b*′ and such action is stopped.

Looking at FIG. 4, therein is seen a fragmentary portion of the liner of FIG. 6 and bows 12 and 13 fixed into the center to left hand collar portion of FIG. 6. What is being seen in that view is the center to lefthand portion of the collar of FIG. 6 from just to the right of the lower opening 28 moving leftwards to the center of the opening 27. At the left in this view, we see a section through the slot 40 and bow 12 upper end 12*b* opening 12*c* with tab 43 firmly engaged in opening 12*c*. The straight end 12*b* of bow 12 can be seen fitting under the outer greater diameter collar portion 12*c* from the top of opening 27 thereabove. The manner in which the recessed portion 37 of liner 30 is inwardly spaced sufficiently to receive the upper end 12*b* of bow 12 may be seen, as well as the fact that its lower end rests on the outwardly angled portion 10*a*′ of collar 10. How top edge 12*d* of bow 12 immediately underlies outwardly formed section 10*b* may also be seen.

Going to the right in FIG. 4, the curved panel 33 which is welded to the inner face 10*c* of the collar may be seen coming up to (going right to) inwardly formed channel member 36 with its slot 39 and spring tab 42. Bow 13 has its straight upper end 13*b* forced the entire height of channel or recess member 36 so its upper edge 13*d* is immediately below outwardly formed collar portion 10*b*′. The tab 42 has engaged opening or slot 13*c*. From this we pass to connection zone or arcuate plate 32 which weld to collar innerface 10*c*.

Referring to FIG. 5, therein is shown a fragmentary interior view of the collar 10 of FIGS. 6 and 4, the view taken somewhat to the right of the view of FIG. 4 in order to show a direct, head-on view of the liner portion 30 receiving the upper end of bow or spring 13. FIG. 5 is equivalent to looking from the right hand extremity of FIG. 6 to the left at the seating of bow 13 in recess 36 in liner 30, with the liner 30 being fastened or welded on to the inside surface of collar portion 10*c*, with bow 13 passing through opening 28 between the two lower collar bearing portions 10*a*. It may be noted also in FIG. 5 that, as is also the case in FIG. 4, the lower edge of recess or channel portion 36 overlies that portion of opening 28 which reaches up into collar portion 10*c*. Tab 42 is received in slot 13*c*. The upper edge of straight portion 13*b* of bow 13, as at 13*d*, may reach the top of slot 39 and channel portion 36 or halt slightly therebelow, the latter seen in FIG. 5, the former seen in FIG. 4. In either case, top end or edge 13*b* of bow 13 is immediately below angled portion 10*b*′, whereby to abut same if bow 13 is driven upwardly in the view.

It should be understood that the construction which is shown in FIGS. 4–6, inclusive with respect to the one collar segment there illustrated is the same for each of the collar segments of the centralizer. The lower collar segments 11 would be inverted with respect to the collars or collar shown in FIGS. 4–6, inclusive. The other collar 10, carrying bows 15–17, inclusive, would be the same, but opposed to the collar seen in FIGS. 4–6, inclusive.

The latter may be seen with respect to FIG. 7 which is an enlarged sectional view taken along the lines 7—7 of FIG. 2 in the direction of the arrows. In the upper half of FIG. 7, we see a sectional view of the assembled structure of FIGS. 4–6, inclusive. The fact that panels or sections 31–34, inclusive lie against and are fixed to larger diameter collar portion 10*c* may clearly be seen. The recess or channel portions 35–37, inclusive may be seen receiving the upper portions 12*b*–14*b*, inclusive of bows or springs 12–14, inclusive. Spring tabs 41–43 are seen received in the slots 12*c*–14*c* of the upper bow end.

In the bottom half of the view of FIG. 7, the opposite collar segment which is seen toward the observer in FIGS. 1 and 2 in the upper portion of those views and in the lower part of FIG. 3 a second liner 30′ is seen welded or otherwise fixedly attached to the inner face of the collar portion 10*c* of this collar segment. The parts which are equivalent on liner 30′ of the lower part of FIG. 7 to like parts on liner 30 of the upper part of FIG. 7 are numbered the same, but primed. In this portion of the view, the upper ends of bows 15′–17′, inclusive, may be seen received within channel portions 35′–37′, inclusive, with spring tabs 41′–43′, inclusive engaging slots 15*c*–17*c*, inclusive of the bow ends 15*b*–17*b*, inclusive.

Additionally, in this view, one manner of attaching the hinge portions together and fabricating the hinges is shown. Thus, looking to the right center in the view of FIG. 7, collar 10*c* is extended beyond insert portion 31 and loops back upon itself in end flange 50. End flange 50 carries or has formed from the inner end thereof the two loop engaging members 22 and 23. With respect to the other collar segment in the lower part of the view of FIG. 7, member 51 is either welded to the end of 10*c* of the said collar segment or made integral therewith. Member 51 is curled or bent over upon itself to provide outer member 52 which slightly overlies the end of portion 10*c* and may be welded or otherwise fixedly attached thereto. Members 51 and 52 carry the three engaging portions 19–21, inclusive.

On the lefthand side of FIG. 7, the equivalent engaging portions have been numbered the same, but primed. As may be seen with respect to FIGS. 1 and 2, when the collars 11 are inverted with respect to collars 10, the hinge members are reversed. Any type of hinge may be employed. Pins 53 are inserted and locked with respect to both upper and lower ends when the device is assembled. Specifically, that is, when the device is assembled, one set of pins 53 on one side of collars 10 and 11 is inserted and fixed with respect to the engaging portions 19–23, inclusive, of the hinge section, whereby the collar segments may be fixed together yet opened as seen in FIG. 8. Then, when the centralizer is mounted on a pipe or casing, the other side of the collar segments are closed upon one another and the other set of pins 53 inserted and provided with enlarged heads or other means at each end thereof whereby the hinges are fixed together to make a complete device embracing the casing 18.

With respect to the liners 30, it is optional whether the portions thereof which are formed inwardly to receive the ends of the bow members, such as at 35–37 inclusive in FIG. 6, are fully or partially slotted to produce tabs such as those at 41–43 inclusive. That is, the portion of the liner above the finger or tab 41–43 inclusive may be removed or left in place. The latter gives the best strength and integrity to the liner structure.

Referring to FIG. 8, therein is shown a top view like that of FIG. 3, save for the fact that the centralizer is open. Depending on the hinge structure, the centralizer may open almost 180° or less. In any case, it must open to more than a 90° arc to be able to receive the casing therewithin or to be mountable on a casing. In order to be truly interchangeable, each centralizer collar must have hinge elements different from one another on the two ends thereof. For example, the left end of the half collar seen to the left in FIG. 8 has the three element (19, 20 and 21) segment of the hinge while the right hand end thereof has the two element (22, 23) hinge element thereon. Looking to the right hand collar half of FIG. 8, and referring to the top collar shown, the left hand element of the view is the three element (19, 20 and 21) hinge portion, while the right hand side of the top collar in the view of FIG. 8 is the two element hinge portion (22, 23).

This construction then, permits the same collar element to be used in every part of the centralizer. Thus, the collar element half which would be positioned under the left hand collar element seen in the view of FIG. 8 (at the lower end of the centralizer) is inverted, whereby at the right portion thereof there would be the two element hinge and centrally the three element hinge structure. Further, referring to the collar half which would be positioned under the right element of FIG. 8, the two element hinge structure would be central and the three element hinge structure to the right. As is seen in the views, the collar elements at the opposite ends of the centralizers are reversed with respect to one another. (FIGS. 1 and 2, see elements 10*a* and 11*a* opposed centrally to one another.)

In on site assembly of the subject device, it should be noted that what is provided to the purchaser or user comprises:

(1) Four collar elements of identical structure, each with hinge elements as described and, additionally, liners or inserts 30 welded or otherwise fixedly attached inwardly of the collars.

(2) The correct number of bows or springs 14–17, inclusive, here six in number.

With respect to one collar half, alone, or two collar halves hinged together at one end thereof, the bows 12–14 or 12–17 are individually inserted at one end thereof into one collar opening 27, 28, 29, etc. and liner recesses 35, 36, 37, etc. and hammered inwardly or toward the outer or lower end of the collar until the leaf spring or tab 41, 42, 43, etc. of the liner springs outwardly into the opening such as 12*c* (FIG. 6) provided in the bow end for such engagement. One by one, the collar half (or two collar halves hinged together) is or are engaged with the three or six spring ends as at 12*b*.

Then, if two separate collars have individually been charged with three spring or bow ends, the two collar halves are hinged together at one end of each. Once any two collars are hinged together and charged with the spring or bow ends, then the two collars are closed at their opposite side and the hinge pinned so both sides of the collar are pinned and the collar fixed in a circle as in FIGS. 1, 2 and 7.

At the point, the half assembled device will comprise a pair of hinged together collars with the one end engaged bows or springs extending upwardly therefrom with free ends. With all the springs or bows engaged in the lower collar of the centralizer, it is not possible to one by one engage the springs or bows at their free ends with individual recesses in the upper collar with its liner. Therefore, what occurs is that another pair of assembled collars, hinged together at both ends thereof (and with the portions 10*a* or 11*a* extending downwardly) are brought to the partially assembled array for engagement of the free ends of the bows or springs in the recesses 35, 36, 37, etc. of the liners 30 through the openings 27, 28, 29, etc. of the second pair of collars. Thus, the bows by hand are bent inwardly or driven inwardly, insofar as required, to be able to make an initial engagement into an opening like 27 and a recess like 37 in a collar element 10 and liner 30. All of the free ends are thus so engaged in the upper pair of hinged together collars. Then the top pair of collars, joined together in a circle, are hammered or pressed (as by a mechanical press) downwardly onto the tops of the engaged bow springs until the upper collar liner tabs 41–43, inclusive, etc. snap into the bow or spring end openings as at 12*c* in FIG. 6. Once this is done, the centralizer is completed. It may then be immediately used or stored in closed, open or half condition, depending on circumstances (the latter by removing all hinge engagements) until ready to be placed on a casing.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A centralizer for mounting on a well casing to function in the annular space between the casing and the well bore or the casing and another casing, said centralizer having a pair of axially spaced apart collars slideably fitted to the exterior of the casing, a plurality of outwardly bowed spring members spanning the space between the collars and substantially equally spaced circumferentially of said collars, one of the ends of each said spring member attached to the upper collar, the opposite end thereof to the lower collar, each said collar having upper and lower end edges of relatively lesser internal diameter, whereby to closely fit and engage said casing with the upper and lower end edges thereof, the intermediate portion of each said collar between said end edges being of greater internal diameter than said upper and lower edges thereof, whereby to be spaced outwardly from said casing when said collars engage same, the inboard, adjacent, edges of said collars and parts of said collar intermediate portion next thereto being cut away in a plurality of spaced apart portions thereof, whereby to receive portions of the ends of the spring members thereunder and therepast, a plurality of arcuate liner members secured to the inside, greater internal diameter portions of each collar between said end edges, inwardly spaced elongate axial recesses formed in said liners opposite said collar cut away portions said recesses extending the entire height of said liners and each having a central vertical slot formed therein, an elongate tab extending from the inboard base of each liner recess slot of a length substantially that of said slot, said tabs angled somewhat radially outwardly within said recess and slot, the ends of said spring members being substantially straight and having openings formed centrally therein near the ends thereof, whereby to receive said tabs therewithin in engaging fashion when the said spring member ends are fully inserted within the length of said recesses.

2. A centralizer construction as in claim 1 wherein the collars are each formed with two sections, said sections hinged and latchable to one another.

3. A centralizer as in claim 1 wherein the greater internal diameter portion of each collar is substantially cylindrical in form whereby to form a substantially cylindrical boss with respect to the upper and lower edges of said collar.

4. A centralizer as in claim 1 wherein the greater internal diameter portion of the collar has an internal clearance with respect to the lesser internal diameter upper and lower edges of the collar at least equal to the thickness of the spring member ends and the thickness of the liner.

5. A device as in claim 1 wherein the liners are substantially equal in height to that of the greater internal diameter portion of the collars.

6. A centralizer for mounting on a well casing to function in the annular space between the casing and a well bore or another casing, said centralizer having a pair of axially spaced apart collars slideably fixed to the exterior of the casing, a plurality of outwardly bowed spring members spanning the space between the collars and substantially equally spaced circumferentially of said collars, one of the ends of each said member attached to the upper collar, the opposite end thereof to the lower collar, each said collars having upper and lower end edges of relatively lesser internal diameter, whereby to closely fit and engage the said casing with the upper and lower end edges thereof, the intermediate portion of each said collar between said end edges being of greater internal diameter than said upper and lower edges thereof, whereby to be spaced outwardly from said casing when said collars engage same, the inboard, adjacent edges of said collars and parts of said collar intermediate portions next thereto being cut away in a plurality of spaced apart portions thereof, whereby to receive portions of the ends of the spring members thereunder and therepast, the collars each being formed of two sections, said sections hinged and latchable to one another, the greater internal diameter portion of each collar being substantially cylindrical in form whereby to form a substantially cylindrical boss with respect to the upper and lower edges of said collar, the greater internal diameter portion of the collars having an internal clearance with respect to the lesser internal diameter upper and lower edges of the collar greater than the thickness of the ends of the spring members and the thickness of the liners, a plurality of arcuate liner members secured to the inside, greater internal diameter portions of each collar between said end edges, inwardly spaced elongate axially recesses formed in said liners opposite said collar cut away portions, said recesses extending the entire height of said liners and having central slots formed therein, an elongate tab extending from the inboard base of each liner recess slot, said tabs angled somewhat radially outwardly within said recess slot, the ends of said spring members being substantially straight and having openings formed centrally therein near the ends thereof, whereby to receive said tabs therewithin in engaging fashion when the said spring members are fully inserted within the length of said recesses, and said liners being substantially equal in height to the greater internal diameter portion of the collars.

* * * * *